US006105707A

United States Patent [19]

Tamura et al.

[11] Patent Number: 6,105,707

[45] Date of Patent: Aug. 22, 2000

[54] TIRED ROLLER

[75] Inventors: Seiji Tamura; Morio Oshina; Tsuyoshi Takayama, all of Ibaraki-ken, Japan

[73] Assignee: Hitachi Construction Machinery Co., Ltd., Tokyo, Japan

[21] Appl. No.: 09/037,028

[22] Filed: Mar. 9, 1998

[30] Foreign Application Priority Data

Dec. 3, 1997 [JP] Japan ..... 9-057971

[51] Int. Cl.[7] ..... B60K 17/00

[52] U.S. Cl. ..... 180/307; 180/308; 180/56; 180/62

[58] Field of Search ..... 180/307, 308, 180/56, 62; 74/417; 464/179, 183

[56] References Cited

U.S. PATENT DOCUMENTS

| | | | |
|---|---|---|---|
| 3,319,545 | 5/1967 | Seaman . | |
| 4,459,875 | 7/1984 | Mann et al. | 180/307 |
| 4,606,428 | 8/1986 | Giere | 180/307 |
| 5,718,535 | 2/1998 | Bachle | 180/307 |
| 5,802,931 | 2/1996 | Louis | 180/307 |
| 5,873,427 | 4/1997 | Ferguson et al. | 180/178 |

FOREIGN PATENT DOCUMENTS

| | | |
|---|---|---|
| 1534272 | 1/1970 | Germany . |
| 941991 | 11/1963 | United Kingdom . |

*Primary Examiner*—J. J. Swann
*Assistant Examiner*—James S. McClellan
*Attorney, Agent, or Firm*—Evenson, McKeown, Edwards & Lenahan, P.L.L.C.

[57] ABSTRACT

A tired roller is provided with a prime mover and a speed change unit of the HST type. The speed change unit includes an HST hydraulic pump of the variable displacement type driven by the prime mover and an HST hydraulic motor driven by pressure oil from the hydraulic pump, and can change a rotational speed of the hydraulic motor by varying a delivery rate of pressure oil from the hydraulic pump. Rotation of the hydraulic motor is therefore transmitted at a lower speed to a drive-axle tire train. A propeller shaft is connected to the hydraulic motor without interposition of any speed reduction mechanism, so that the propeller shaft is rotated at a high speed with a low torque. This has made it possible to form the propeller shaft smaller in diameter and hence to arrange it in a narrow space between tires in the drive-axle tire train. Further, the rotation of the hydraulic motor is reduced in speed at an output side of the propeller shaft, thereby making it possible to transmit the rotation in a state increased in rotating torque to the drive-axle tire train.

6 Claims, 8 Drawing Sheets

TIRED ROLLER

BACKGROUND OF THE INVENTION a) Field of the Invention

This invention relates to a tired roller for finishing a paved surface of asphalt or the like by performing rolling compaction of the paved surface with rubber tires in the form of wheels.

b) Description of the Related Art

A tired roller is a construction vehicle, which is equipped with rubber tires and is adapted to rolling-compact a paved surface of asphalt by the rubber tires. When applying asphalt paving, a roadbed which has not been paved with asphalt is first roughly finished by performing rolling compaction with a construction vehicle having steel wheels and then, a paved surface of asphalt is formed on the roadbed. The tired roller performs rolling compaction of the paved surface with the rubber tires to finish the paved surface. The present invention is to make improvements in a travelling mechanism of such a tired roller. To facilitate the understanding of the present invention, fundamental technical details of a conventional general tired roller will first be described with reference to FIG. 9 and FIG. 10. FIG. 9 is a side view showing the overall image of the conventional general tired roller by cutting off a rear section, and FIG. 10 is a rear view of a left half of the tired roller.

Illustrated in FIG. 9 and FIG. 10 are a tired roller main body 1 as a self-traveling vehicle body capable of travelling by itself with rubber tires, a prime mover 2 as a power source for the tired roller main body 1, a hydraulic pump 3 for an HST, said hydraulic pump being driven by said prime mover 2, a hydraulic motor 4 for the HST, said hydraulic motor being adapted as a traveling motor driven by pressure oil from said hydraulic pump 3, a speed reduction gear 5 connected to an output shaft of the hydraulic motor 4 and adapted as a speed reduction mechanism for reducing a rotational speed of the hydraulic motor to provide an increased rotating torque, a chain drive mechanism 6 composed of a small-diameter sprocket on an input side, a large-diameter sprocket on an output side and an endless chain mounted on the sprockets and adapted to transmit rotation of the speed reduction gear 5 to a drive axle of a below-described drive-axle tire train 7, the drive-axle tire train 7 as rear wheels driven as a result of transmission of rotation of the hydraulic motor 4 via the chain drive mechanism 6, and an idle-axle tire train 8 as front wheels. Incidentally, "HST" is an abbreviation of a hydrostatic transmission which is a type of transmission.

The hydraulic pump 3 is a variable displacement hydraulic pump, which has a bi-directionally tiltable swashplate and can vary a delivery rate of pressure oil. Pressure oil can be delivered in a desired one of normal and reverse directions by operating the swashplate to the corresponding one of positive and negative regions. The rotational speed of the hydraulic motor 4 can be varied in a stepless, continuous manner by changing the delivery rate of pressure oil from the variable displacement hydraulic pump 3. As the hydraulic pump 3 is of the bi-directionally tiltable type, the tired roller can be moved forward or rearward while varying its speed in a stepless manner. In the conventional tired roller, the hydraulic motor 4 is arranged so that the length of its drive shaft extends in a parallel direction, that is, in a direction parallel to the drive-axle tire train 7. The HST (hydrostatic transmission) is constructed by a combination of these variable displacement hydraulic pump 3 and hydraulic motor 4. As a tired roller has a significantly greater vehicle weight than general vehicles, the speed reduction gear 5 is arranged to increase rotating torque to permit traveling of such a heavy tired roller, so that no problem arises concerning travelling of the tired roller. The chain drive mechanism 6 is provided with a bearing 6*a*, which is disposed upright to rotatably support a rotary shaft of a sprocket of the chain drive mechanism. This upright disposition of the bearing has made it possible to its arrangement in a narrow space between adjacent tires in the drive-axle tire train 7.

Individual tires in the drive-axle tire train 7 and idle-axle tire train 8 are all rubber tires so that, when the tired roller main body 1 is caused to travel, they can rolling-compact and finish a paved surface of asphalt. The drive-axle tire train 7 and the idle-axle tire train 8 are each constructed by mounting many tires, for example, three tires in the case of wide tires or 4 to 5 tires in the case of narrow tires on a drive axle or an idle axle to make up a tire train. In FIG. 10, only the left half of the drive-axle tire train 7 is illustrated, and its right half is not shown. A drive-axle tire train similar to that shown in FIG. 10 is also arranged on the side of the right half. This conventional example is therefore designed in such a way that two tires are mounted on each of the drive axles of the drive-axle tire trains 7 arranged separately on the left and right sides to form a tire train of four tires in total. The tired roller main body 1 is provided with the above-described prime mover 4, hydraulic pump 3, hydraulic motor 4 and speed reduction gear, and also with a fuel tank, a working oil tank and the like. By using remaining spaces where such elements are not arranged, for example, a space above the idle-axle tire train 8 and other spaces, water tanks (not shown) are arranged at various places. These water tanks are formed by surrounding such remaining spaces with walls, and serve to make the vehicle weight greater to provide an increased ground pressure upon rolling compaction. Accordingly, these water tanks account for a substantial part of the volume of the tired roller main body 1, for example, become as heavy as 4 to 5 tons when the total working weight of the tired roller is 15 tons.

For the adoption of the above-described construction, the conventional tired roller is operated as will be described hereinafter. The prime mover 2 is operated to drive hydraulic pump 3. The delivery rate of pressure oil from the hydraulic pump is controlled according to a stroke of an operation lever, whereby the hydraulic motor 4 is driven at a desired rotational speed in accordance with a delivery rate of the hydraulic pump 3. The rotation of the hydraulic motor 4 is then transmitted, in a state increased in rotating torque by the speed reduction gear 5, to the drive axle of the drive-axle tire train 7 via the chain drive mechanism 6, so that the tired roller is allowed to travel at a desired speed without any problem. Further, the traveling direction of the tired roller can be controlled by operating the idle-axle tire train 8 through a steering wheel. Accordingly, the tired roller can travel to and fro on roads and can also travel on paved surfaces for rolling compaction.

In the conventional tired roller, however, the transmission of rotation of the hydraulic motor 4 to the drive-axle tire train 7 requires to transmit rotation of a high torque, which has been obtained by reducing the speed of the first-mentioned rotation at the speed reduction gear 5, through a power transmission. Moreover, for the characteristic feature that a wheel is constructed by the tire train, the power transmission must be arranged in the small space between the adjacent tires in the drive-axle tire train 7. As the power transmission, the chain drive mechanism 6 is therefore used generally. This chain drive mechanism 6 however cannot avoid occurrence of a slack in its chain. Due to this slack, a kick back takes place in the drive-axle tire train 7 upon starting or stopping the tired roller, resulting in the formation of a wave on a road surface finished by rolling compaction. There are hence problems that a great deal of labor is required for manually touching up waves formed by such kick backs and that the finished accuracy of a road surface finished by rolling compaction is insufficient. These problems are worsened especially when rolling-compaction finishing work is performed on a slope or when rolling-compaction finishing work is conducted by employing a tired roller which has been used over a long time. Further, the conventional tired roller requires chain tension adjustments because, for its characteristic feature as a rolling vehicle, the vehicle weight is designed to be significantly heavy compared with general vehicles and its chain becomes longer when used for a certain time. This chain tension adjustment is to apply tension to the chain by cutting the heavy and large chain shorter or by lifting the sprocket, on which the chain is mounted, and changing its mounted position, and is extremely difficult work.

SUMMARY OF THE INVENTION

With a view to eliminating problems such as those observed on conventional tired rollers, an object of the present invention is to provide a tired roller which can be started and stopped without forming kick-back-associated waves on a road surface while finishing the road surface by rolling compaction.

The above object of the present invention can be achieved by a tired roller provided with:

a prime mover, a speed change unit having a variable displacement hydraulic pump and a hydraulic motor driven by pressure oil from the variable displacement hydraulic pump and capable of changing a revolution speed of the hydraulic motor by changing a delivery rate of the pressure oil from the variable displacement hydraulic pump, and a speed reduction mechanism for reducing a rotational speed of the hydraulic motor to provide an increased rotating torque, whereby rotation of the speed reduction mechanism is transmitted to a drive axle of a drive-axle tire train, wherein a propeller shaft is connected on an input side thereof to an output side of the hydraulic motor of the speed change unit so that the propeller shaft extends through a space between adjacent tires in the drive-axle tire train; and the propeller shaft is provided on an output side thereof with the speed reduction mechanism so that rotation of the hydraulic motor, which has been transmitted via the propeller shaft, is reduced in speed by the speed reduction mechanism and is then transmitted to the drive axle of the drive-axle tire train.

As the tired roller according to the present invention has adopted the above-described technical features, it brings about various advantageous effects. When the prime mover is operated to drive the hydraulic motor of the speed change unit via the hydraulic pump of the speed change unit, rotation of the hydraulic motor is transmitted to the propeller shaft so that the propeller shaft is rotated at a high speed with a low torque. After that, the rotation is reduced in speed by the speed reduction mechanism on the output side of the propeller shaft and is transmitted, in a state increased in rotating torque, to the drive axle of the drive-axle tire train, whereby the tired roller of a heavy vehicle weight is allowed to travel without problems. As a drive mechanism for transmitting rotation of the hydraulic motor to the drive-axle tire train, the propeller shaft is used in place of a chain drive mechanism which has heretofore been used. This has made it possible to avoid the kick-back-associated formation of a wave on a road surface under finishing by rolling compaction at the time of a start or stop of the tired roller, and further to obviate a chain tension adjustment. In addition, unlike the chain drive mechanism employed to date, the propeller shaft is rotated at a high speed with a low torque so that the propeller shaft can be formed smaller in diameter. This has made it possible to easily arrange the propeller shaft in the narrow space between the adjacent tires in the drive-axle tire train.

Moreover, the use of the propeller shaft instead of a chain drive mechanism as the mechanism for transmitting rotation of the hydraulic motor to the drive axle of the drive-axle tire train can eliminate meshing noise which would otherwise occur between the chain and its associated sprockets and would become a problem in urban areas, and can also obviate greasing the chain which would otherwise be required everyday. In addition, compared with use of a chain drive mechanism the power transmission efficiency of which is not good, the use of the propeller shaft permits efficient transmission of power of the prime mover to the drive-axle tire train, thereby making it possible to reduce the fuel consumption of the prime mover.

In order to transmit rotation of the hydraulic motor to the drive axle of the drive-axle tire train at a speed reduced by the speed reduction mechanism, an axle provided with the drive axle of the drive-axle tire train may be arranged, and the axle may be provided with the speed reduction mechanism. This preferred embodiment can bring about the above-described basic advantageous effects, and can also bring about an advantageous effect that devices and equipments around the drive-axle tire train can be brought closer to each other and arranged in a compact space, the limited space of the tired roller can be effectively used, and maintenance and inspection work can be facilitated.

Preferably, the speed reduction mechanism may be constructed of a planetary gear speed-reduction mechanism, which is arranged concentrically with the drive axle of the drive-axle tire train, and a gear transmission mechanism comprising a bevel gear arranged on an input side of the planetary gear speed-reduction mechanism and a pinion arranged on the output side of the propeller shaft and meshing with the bevel gear, so that an axis of rotation to be transmitted from the propeller shaft to the drive axle of the drive-axle tire train may be changed in direction by the gear transmission mechanism to extend in the same direction as an axis of the drive axle. This preferred embodiment can also bring about an additional advantageous effect that the speed reduction mechanism and direction changing mechanism can be conveniently arranged within a small space around the drive axle of the drive-axle tire train.

Desirably, the hydraulic motor may be arranged with an output shaft thereof extending downwardly, and accordingly, the propeller shaft may be arranged extending downwardly. This desired embodiment makes it possible to retain an ample space around the hydraulic motor in the tired roller main body and to reduce a dead space, so that the overall volume of water tanks can be increased.

DETAILED DESCRIPTION OF THE INVENTION AND PREFERRED EMBODIMENT

Figure 1:
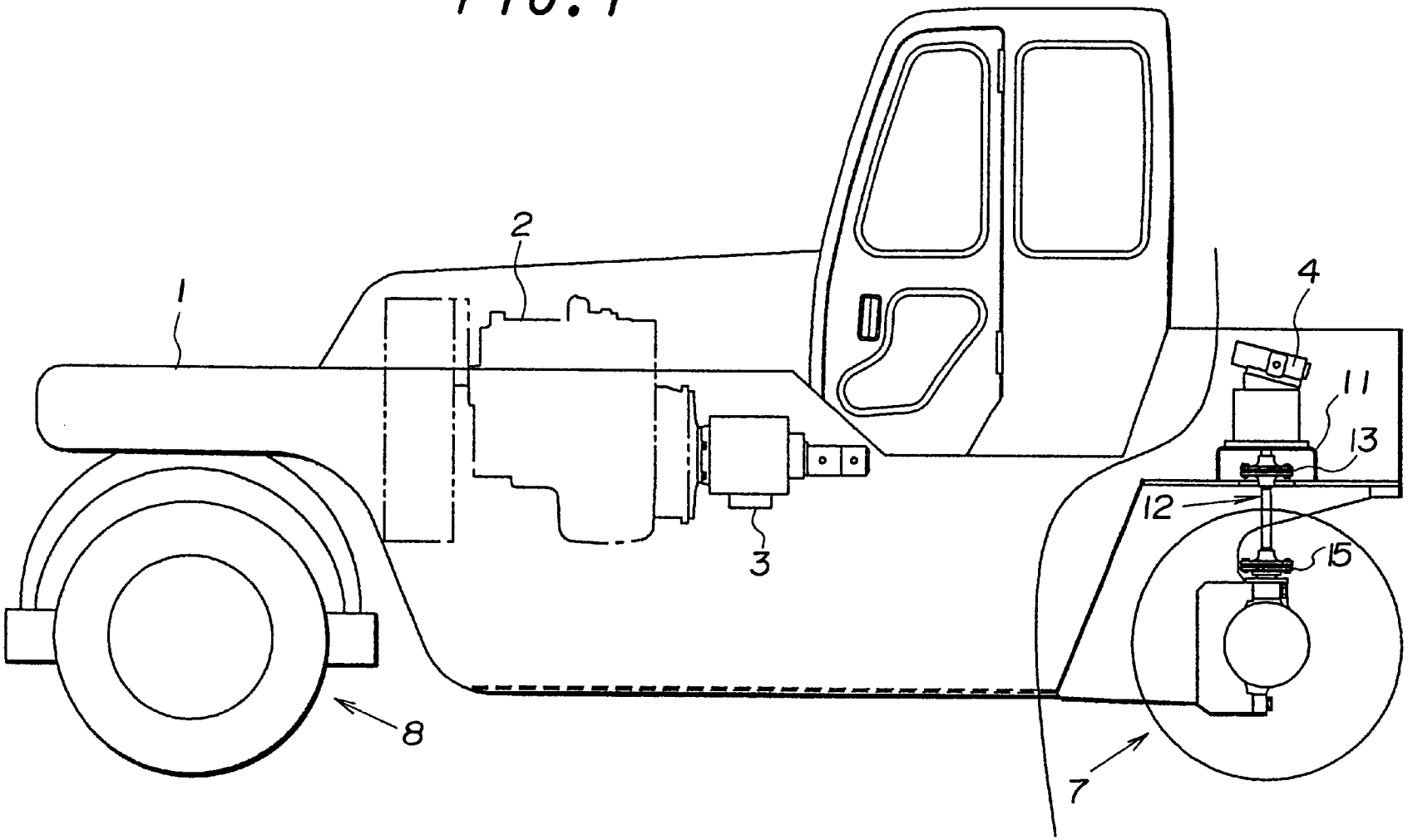
FIG. 1 is a side view showing the overall image of a tired roller according to a specific embodiment of the present invention by cutting off a rear section thereof.
Figure 2:
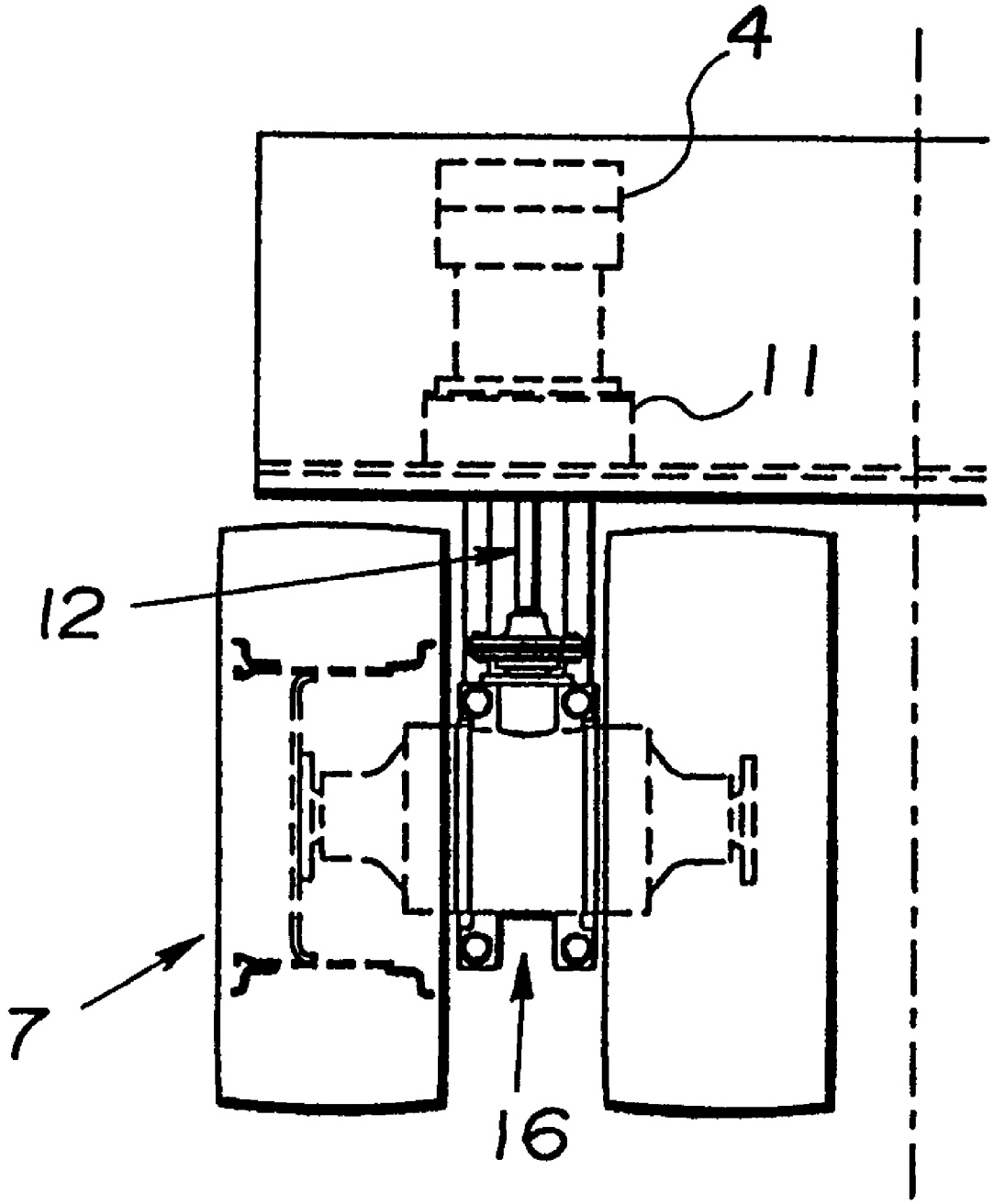
FIG. 2 is a rear view of a left half of the tired roller of FIG. 1.
Figure 3:
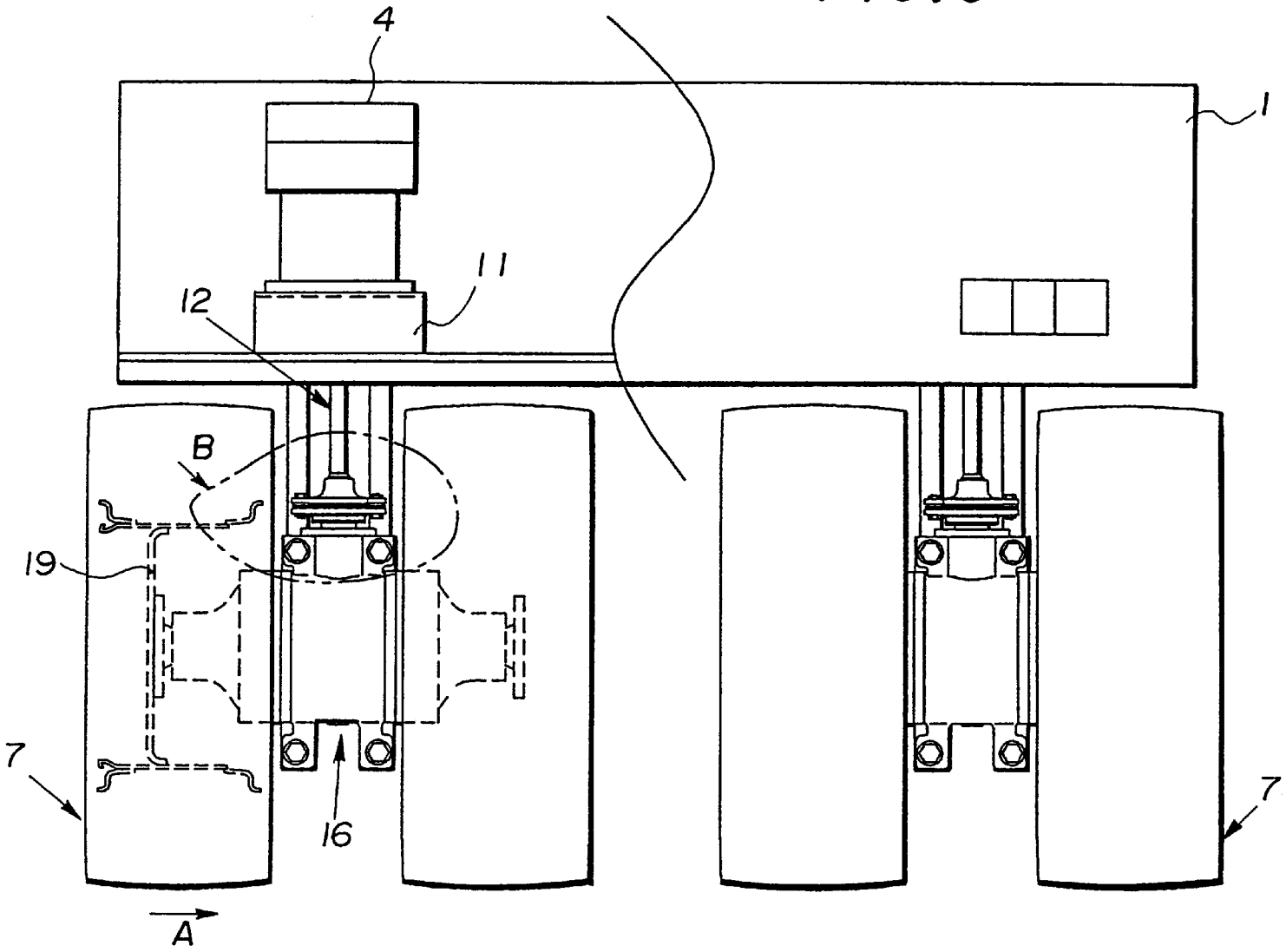
FIG. 3 is a partly cut-off rear view illustrating essential parts of the tired roller according to the specific embodiment of the present invention.
Figure 4:
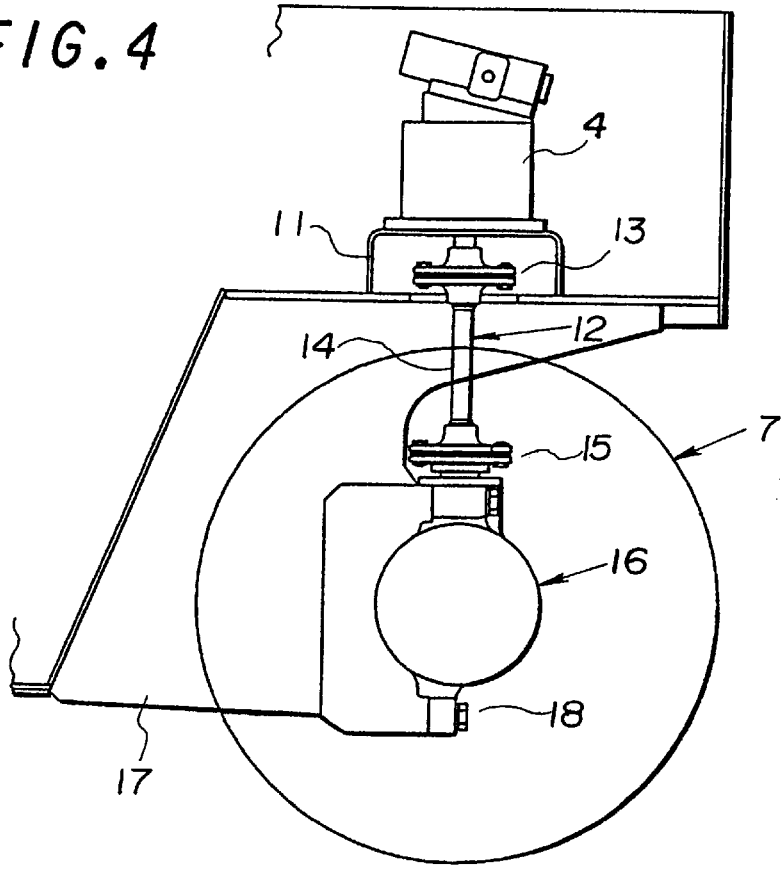
FIG. 4 is a view seen in a direction of arrow A in FIG. 3.

A mode of practice of the present invention will become apparent from the following description of the specific embodiment, which specifically illustrates on the basis of FIG. 1 through FIG. 8 how the present invention can be embodied actually. In FIG. 1 through FIG. 8, like reference numerals as in the above-described FIG. 9 and FIG. 10 indicate like elements of structure and, therefore, such elements of structure will not be described in detail.

Figure 9:
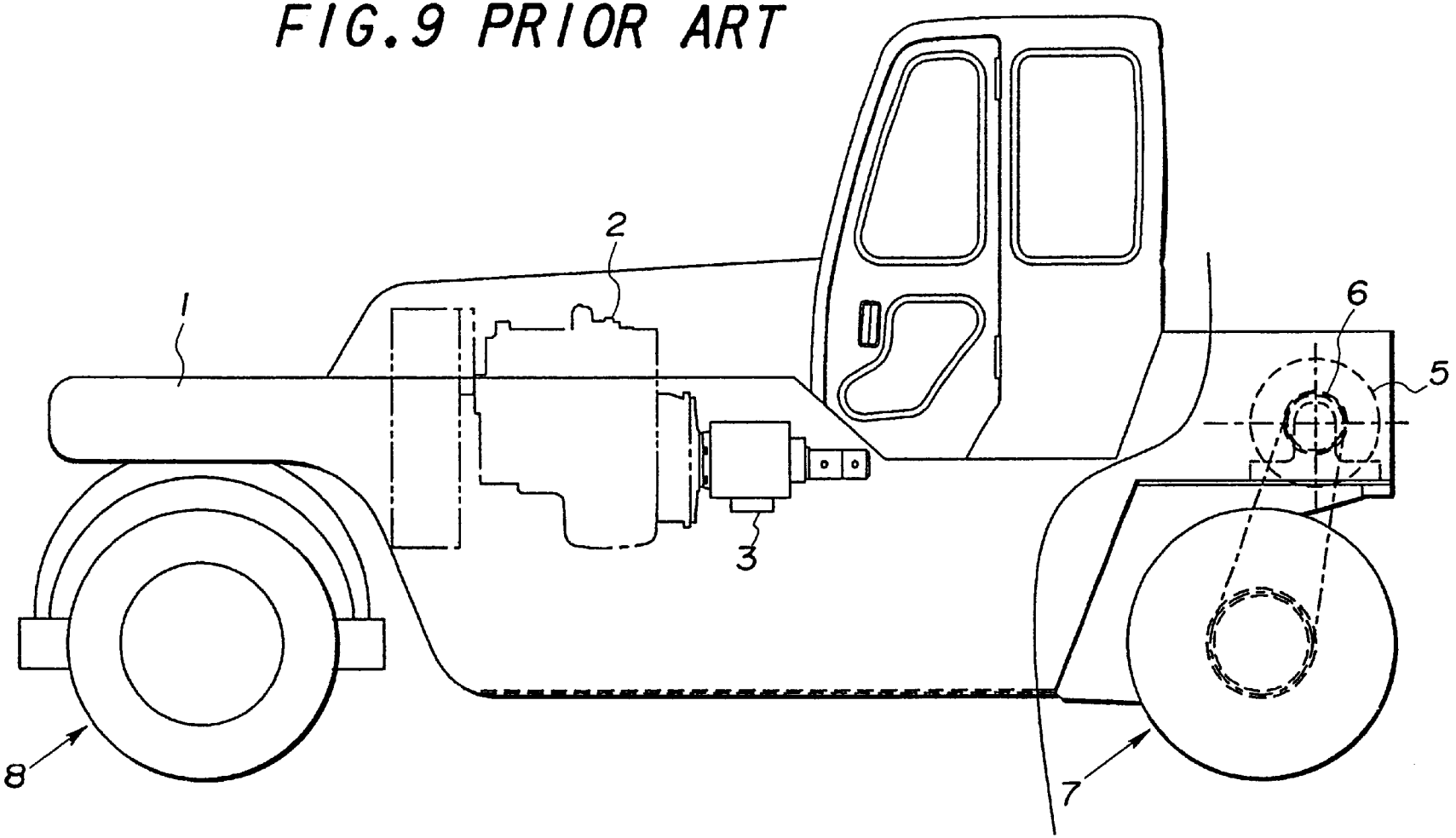
FIG. 9 PRIOR ART
FIG. 9 is a side view showing the overall image of a conventional general tired roller by cutting off a rear section thereof.
Figure 10:
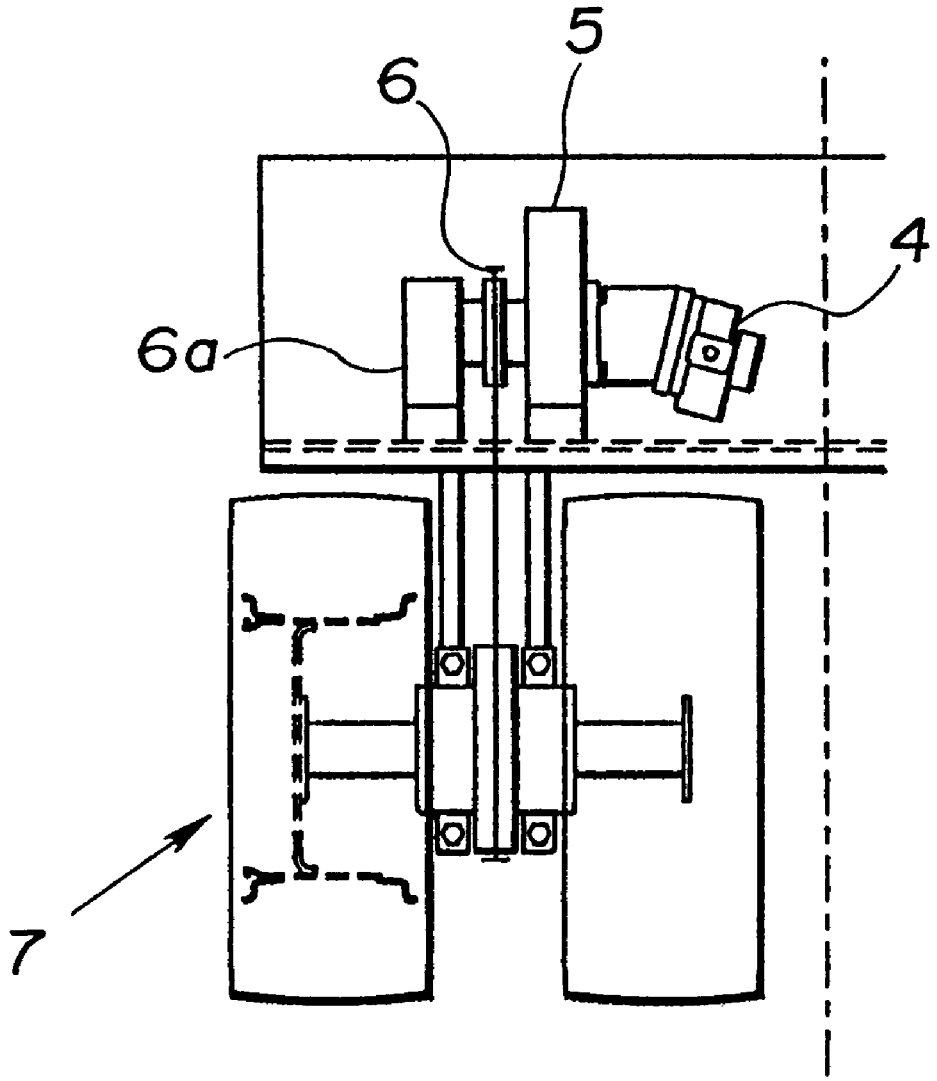
FIG. 10 PRIOR ART
FIG. 10 is a rear view of a left half of the tired roller of FIG. 9.

Like the conventional tired roller shown in FIG. 9 and FIG. 10, the tired roller according to the above specific embodiment of the present invention is provided with a tired roller main body 1, a prime mover 2, an HST having an HST hydraulic pump 3 of the variable displacement type driven by the prime mover 2 and an HST hydraulic motor 4 driven by pressure oil from the hydraulic pump 3 and adapted as a speed change unit capable of changing a rotational speed of the hydraulic motor 4 by changing a delivery rate of pressure oil from the hydraulic pump of the variable displacement type, a speed reduction mechanism for reducing a rotational speed of the hydraulic motor to provide an increased rotating torque, a drive-axle tire train 7, and an idle-axle tire train 8, whereby rotation of the speed reduction mechanism is transmitted to a drive axle of the drive-axle tire train 7. The tired roller according to the specific embodiment is therefore not different in basic construction from the conventional tired roller. Further, the drive-axle tire train 7 is designed so that, as is shown well in FIG. 3, the tire train includes four tires, two tires on one of drive axles separately arranged on left and right sides and the other two tires on the other drive axle. In this respect too, the tired roller according to this specific embodiment is not different from the conventional tired roller.

With reference to FIG. 1 through FIG. 8, a description will hereinafter be made about characteristic technical details of the tired roller according to the specific embodiment of the present invention. In these drawings, there are shown a hydraulic motor bracket 11 for mounting the hydraulic motor 4, a propeller shaft 12 as a constant velocity joint for transmitting rotation of the hydraulic motor 4 to the drive axles of the drive-axle tire train 7 while maintaining the rotation at the constant velocity, a diaphragm coupling 13 arranged in an internal space of the hydraulic motor bracket 11 and constituting an input-side coupling portion of the propeller shaft 12, a spline shaft 14 making up an intermediate part of the propeller shaft, a diaphragm coupling 15 making up an output-side coupling portion of the propeller shaft 12, an axle 16 enclosing therein the drive axles of the drive-axle tire train 7, and axle-mounting brackets 17 arranged on a rear part of the tired roller main body 1. Different from the conventional tired roller, the hydraulic motor 4 in this specific embodiment is arranged so that its output shaft extends downwardly in a vertical direction. Accordingly, the propeller shaft 12 is also arranged extending downwardly in the vertical direction. The diaphragm coupling 13 of the propeller shaft 12 is connected through splines with the output shaft of the hydraulic motor 4, and the diaphragm coupling 15 is connected to an input portion of the axle 16 which serves to transmit rotating power to the drive axles of the drive-axle tire train 7.

Figure 5:
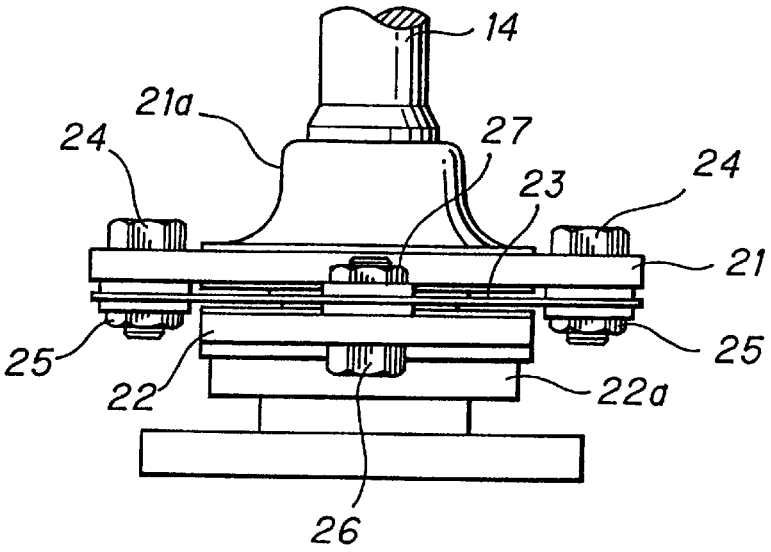
FIG. 5 is an enlarged fragmentary view of a propeller shaft, which shows a part B of FIG. 3 on an enlarged scale.
Figure 6:
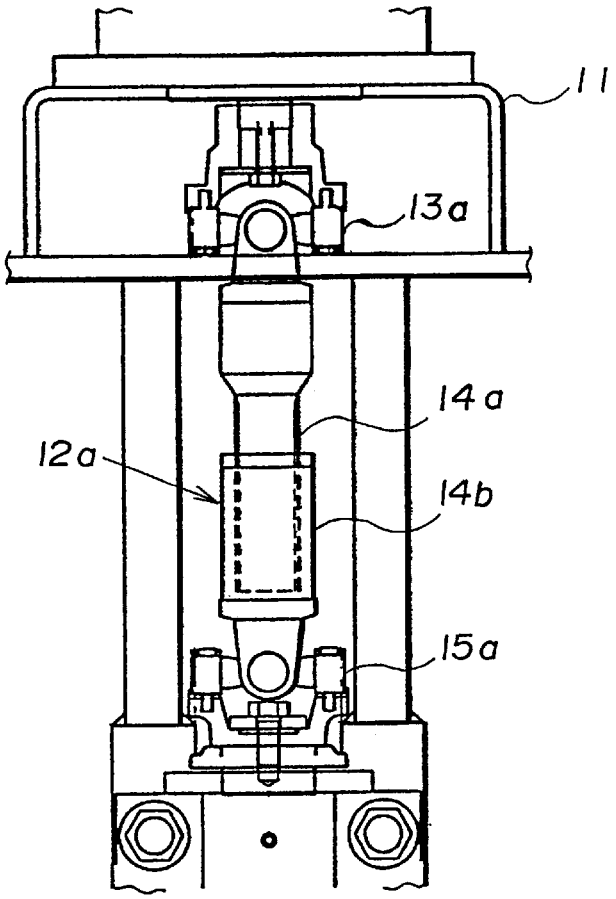
FIG. 6 is a side view illustrating another example of the propeller shaft, which is usable upon practice of the present invention.

Referring next to FIG. 5, details of the diaphragm couplings 13,15 will be described by taking the diaphragm coupling 15 as an example. As is shown in the drawing, the diaphragm coupling 15, roughly describing, is constructed of an upper connecting portion 21*a*, an upper fitting member 21 arranged in association with the upper connecting portion, a lower connecting portion 22*a*, a lower fitting member 22 arranged in association with the lower connecting portion, and a diaphragm 23 disposed between the upper fitting member 21 and the lower fitting member 22. The upper connecting portion 21*a* is substantially cylindrical, and is provided on its inner peripheral wall with splines which can be maintained in engagement with splines arranged on an outer periphery of a lower end portion of the spline shaft 14. Since this spline shaft 14 is inserted into and connected to the upper connecting portion 21*a* so that they are connected together through the splines, the spline shaft 14 can extend out from and into the upper connecting portion 21*a*, thereby making it possible to adjust the extended length of the spline shaft. On the other hand, the lower connecting portion 22*a* is connected to the input portion of the axle 16.

Although not shown in FIG. 5, the upper fitting member 21 and the lower fitting member 22 are both of an approximately rectangular shape, and are dimensioned so that the short sides become substantially equal to or slightly greater than the outer diameter of a cylindrical portion of the connecting portion 21*a*. They are arranged to extend crosswise relative to each other. The diaphragm 23 is formed in the shape of an approximately square with a thin metal sheet having flexibility. A diagonal of the square is set to have substantially the same length as the long sides of the upper fitting member 21 and lower fitting member 22. Upon arranging the diaphragm 23 between the upper fitting member 21 and the lower fitting member 22, the diaphragm 23 is arranged so that the upper fitting member 21 and the lower fitting member 22, which extend crosswise relative to each other, are positioned on mutually-crossing diagonals of the square diaphragm 23. The upper fitting member 21 and the diaphragm 23 are fastened together by bolts 24 and nuts 25 at two corners on one of the diagonals, the lower fitting member 22 and the diaphragm 23 are fastened together at two corners on the other diagonal. In FIG. 5, the relative positions of fastened portions of the thus-fastened upper fitting member 21 and diaphragm 23 by the bolts 24 and the nuts 25 and those of the thus-fastened lower fitting member 22 and the diaphragm 23 by the bolts 26 and the nuts 27 are shown on an enlarged scale. Because the upper fitting member 21 and the lower fitting member 22 are independently attached to the diaphragm 23 on its respective diagonals, these fitting members 21,22 can be tilted in desired directions owing to the flexibility of the diaphragm 23.

The diaphragm coupling 15 has been described in the above. Like the diaphragm coupling 15, the diaphragm coupling 13 is also constructed of upper and lower connecting portions, upper and lower fitting members, and a diaphragm. In this case, the upper connecting portion is provided with splines which can be maintained in engagement with splines on an outer periphery of the output shaft of the hydraulic motor 3, whereas the lower connecting portion is provided with splines which can be maintained in engagement with splines on an outer periphery of an upper end portion of the spline shaft 14. The propeller shaft 12 is provided on input and output sides thereof with the diaphragm coupling 13 and diaphragm coupling 15 of the above-described constructions. Even if there is an offset between the axis of the output shaft of the hydraulic motor 3 and the axis of the input portion of the axle 16, rotation of the hydraulic motor 3 can therefore be smoothly transmitted to the input portion of the axle 16 while maintaining it at a constant velocity provided that the spline shaft 14 is connected in an inclined position to both diaphragm couplings 13,15 while maintaining the axes in parallel with each other.

As has been described above, the propeller shaft is a rotating force transmitting mechanism, which connects the output shaft of the hydraulic motor with the input portion of the axle tiltably relative to each other by the shaft to transmit rotation of the output shaft to the input portion via the shaft. When practicing the present invention, the rotating force transmitting mechanism is not limited to one making use of the diaphragm couplings 13,15 but, insofar as such tiltable connection is feasible, propeller shafts of other types such as a propeller shaft of the universal joint type can be used. Accordingly, a description will next be made of a propeller shaft of the universal joint type as another example of propeller shafts on the basis of FIG. 6. The propeller shaft of the universal joint type, which is designated at sign 12*a*, connects opposite end portions of its shaft 14*a* with the output shaft of the hydraulic motor 4 and the input portion of the axle 16 by universal joints 13*a*,15*a*, respectively, so that the output shaft of the hydraulic motor 4 and the input portion of the axle 16 are tiltable in desired directions relative to each other In this case, the shaft 14*a* is constructed of two shafts which are in fitting engagement with each other. These shafts are telescopically connected together through splines at fitted portions 14*b*. Even if there is an offset between the axis of the output shaft of the hydraulic motor 3 and the axis of the input portion of the axle 16, use of this propeller shaft 12*a* of the universal joint type can also smoothly transmit rotation of the hydraulic motor 3 to the input portion of the axle 16 at a constant speed like the use of the above-described propeller shaft of the diaphragm type. Among such propeller shafts, the propeller shaft of the diaphragm type has a merit in that it does not require greasing to rotating portions, and the propeller shaft of the universal joint type has a merit in that it permits greater tilting angles between the output shaft and input portion and the shaft than the propeller shaft of the diaphragm type.

The axle 16 is mounted on a rear section of the tired roller main body 1 by fixing it on the axle-mounting brackets 17 by fastening bolts 18. This axle 16 encloses the drive axle of the drive-axle tire train 7, bearings of the drive axle and the like within a casing, and tire-mounting rims 19 are mounted on horizontally opposite end portions of the drive axle. The axle 16 is hence constructed as an assembly of these components. In this specific embodiment, the speed reduction mechanism, which serves to reduce a rotational speed of the hydraulic motor and hence to provide an increased rotating torque, is arranged in addition to such drive axle and bearings inside the axle 16. Owing to the arrangement of the speed reduction mechanism on the output side of the propeller shaft 12 in this specific embodiment, the propeller shaft 12 is rotated at a high speed with a low torque and the rotating torque is increased by the speed reduction mechanism on the downstream side of the propeller shaft 12. Compared with the arrangement of the speed reduction mechanism on the input side of the propeller shaft 12, this specific embodiment has made it possible to form the propeller shaft 12 smaller in diameter. As a result, the propeller shaft 12 can be easily arranged in the narrow space between the adjacent tires in the drive-axle tire train 7. Incidentally, the chain drive mechanism 6 of the conventional tired roller, said chain drive mechanism being a power transmitting mechanism corresponding to the propeller shaft 12, is provided on the input side thereof with the speed reduction gear 5 as a speed reduction mechanism as described above because the chain drive mechanism is not suited for being driven at a high speed with a low torque. For these limitations, the conventional tired roller is different in the arrangement of its speed reduction mechanism from the tired roller according to this specific embodiment.

Figure 7:
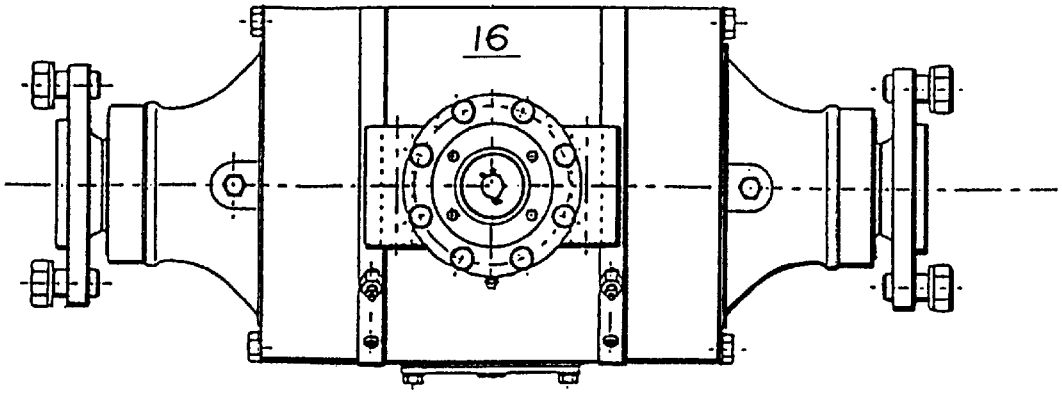
FIG. 7 is a plan view showing an axle portion of the tired roller according to the specific embodiment of the present invention.
Figure 8:
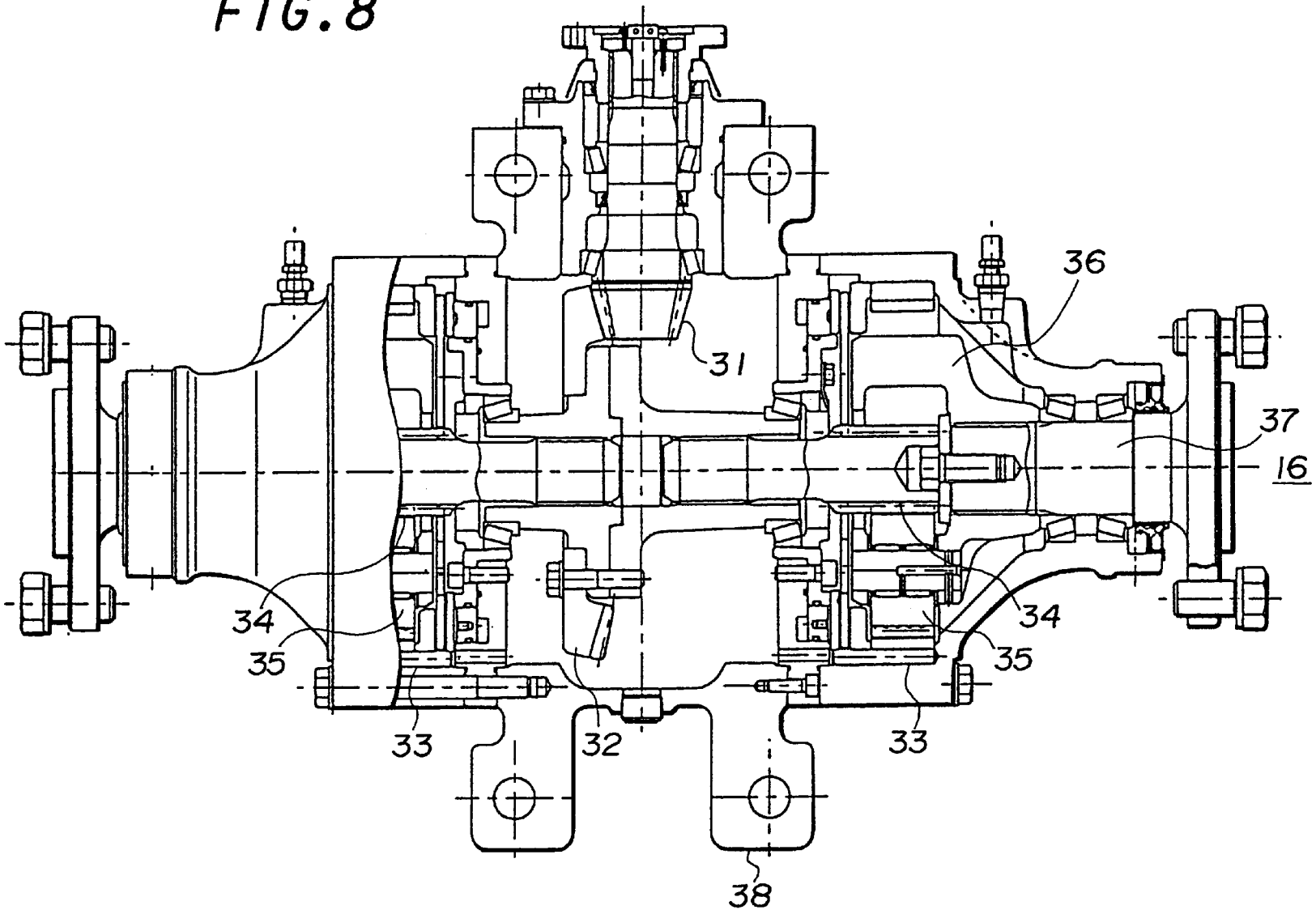
FIG. 8 is a transverse cross-sectional view depicting on an enlarged scale the axle portion of the tired roller according to the specific embodiment of the present invention.

Referring next to FIG. 7 and FIG. 8, a description will be made about the speed reduction mechanism in this specific embodiment. In these drawings, there are illustrated a pinion 31 in the form of a bevel gear, said pinion being attached to the output side of the propeller shaft 12, specifically to the connecting portion 22*a* of the diaphragm coupling 15, a bevel gear 32 arranged on an input side of a planetary gear speed-reduction mechanism and maintained in meshing engagement with the pinion 31, a ring gear 33 having a ring shape and carrying teeth on an inner periphery thereof, a sun gear 34 rotatably supported on a central part of the ring gear 33 and carrying teeth on an outer periphery thereof, a planetary gear 35 carrying teeth on an outer periphery thereof and supported in such a way that the planetary gear can revolve while rotating on the outer periphery of the sun gear 34 with the teeth thereof maintained in meshing engagement with the teeth of the sun gear 34 and the teeth of the ring gear 33, an arm 36 arranged concentrically with the sun gear 34 for rotation via a rotary shaft so that the arm allows the planetary gear 35 to revolve while undergoing rotation, an axle shaft 37 as the drive axle of the drive-axle tire train 7, and mounting members 38 for mounting the axle 16 on the tired roller main body 1. The planetary gear speed-reduction mechanism in this specific embodiment is composed of these ring gear 33, sun gear 34, planetary gear 35 and arm 36. The sun gear 34 serves as a drive member, while the arm 36 acts as a driven member and is mounted concentrically on the axle shaft 37. The ring gear 33 is fixed so that it does not rotate. The bevel gear 32 is fixed so that its center of rotation coincides with an axis of rotation of the sun gear 34 to transmit its rotation to the sun gear 34. In this specific embodiment, two drive axles are arranged in a pair on left and right sides for the drive-axle tire train 7. Accordingly, two hydraulic motors 4, propeller shafts 12 and planetary gear speed-reduction mechanism are arranged in pairs on the left and right sides, thereby making it possible to independently drive the left and right drive axles of the drive-axle tire train 7.

As the tired roller according to the specific embodiment of the present invention is provided with such a construction as described above, it is operated as will be described hereinafter. When the hydraulic motor 4 is driven, rotation of the hydraulic motor 4 about a vertical axis is transmitted, as is, to the propeller shaft 12 to rotate the propeller shaft at a high speed with a low torque, whereby the rotation is transmitted to the pinion 31 as the input portion of the axle 16 via the propeller shaft 12. By the gear transmission mechanism composed of the pinion 31 and the bevel gear 32, the rotation of the hydraulic motor 4 is transmitted to the sun gear 34 at a reduced speed and, further, is directionally changed so that the axis of the rotation is changed from the vertical direction to a horizontal direction, that is, the direction of the drive axle of the drive-axle tire train 7. When the sun gear 34 is then driven, the planetary gear 35 revolves while rotating in an opposite direction to the sun gear 34 because the ring gear 3 is fixed, and at the same time, the planetary gear transmits its rotation to the arm 36 during its revolution. As a result, the arm 36 also rotates in the same direction as the sun gear 34 to drive the axle shaft 37 attached to the arm 36. Accordingly, the rotation of the hydraulic motor 4 is reduced twice in speed, firstly by the direction change and speed reduction mechanism, which is composed of the pinion 31 and the bevel gear 32, and secondly by the speed reduction mechanism composed of the planetary gear speed-reduction mechanism. The rotation of the hydraulic motor is thus transmitted, in a state increased in rotating torque, to the drive axle of the drive-axle tire train 7, so that the tired roller of the heavy vehicle weight is allowed to travel without any problems.

As has been described above, this specific embodiment makes use of the propeller shaft 12 as the mechanism for transmitting rotation of the hydraulic motor 4 to the drive-axle tire train 7 without relying upon the conventionally-employed chain drive mechanism 6. It is therefore possible to avoid the formation of a wave on a road surface under finishing by rolling compaction at the time of a start or stop of a tired roller and, moreover, no chain tension adjustment is needed. In addition, the propeller shaft 12 is designed to rotate at a high speed with a low torque unlike the conventionally-employed chain drive mechanism 6, so that the propeller shaft 12 can be formed smaller in diameter. This has made it possible to easily arrange the propeller shaft in the narrow space between the adjacent tires in the drive-axle tire train 7. Further, the use of the propeller shaft 12 rather than the chain drive mechanism 6 can eliminate noise which would otherwise be produced as meshing sound between the chain and its associated sprockets and become a problem in urban areas, and can also obviate greasing of the chain which would otherwise be required everyday. Moreover, compared with the use of the chain drive mechanism 6 the power transmission efficiency of which is not good, the use of the propeller shaft permits efficient transmission of power of the prime mover 2 to the drive-axle tire train 7, thereby making it possible to reduce the fuel consumption of the prime mover 2.

To transmit rotation of the hydraulic motor 4 to the drive axle of the drive-axle tire train 7 after reducing the speed of the rotation by the speed reduction mechanism, this specific embodiment features the use of the axle 16 in which the drive axle of the drive-axle tire train 7 is arranged, thereby making it possible to bring devices and equipments, which are located around the drive-axle tire train, closer to each other and to arrange them in a compact space. Therefore, the limited space of the tired roller can be effectively used, and maintenance and inspection work can be facilitated. Further, the speed reduction mechanism is composed of the gear transmission mechanism, which comprises the planetary gear speed-reduction mechanism arranged concentrically with the drive axle of the drive-axle tire train 7, the bevel gear 23 arranged on the input side of the planetary gear speed-reduction mechanism and the pinion 31 arranged on the output side of the propeller shaft 12 and maintained in meshing engagement with the bevel gear 32. By this gear transmission mechanism, the axis of rotation to be transmitted from the propeller shaft 12 to the drive axle of the drive-axle tire train 7 is directionally changed to extend in the direction of the axis of the drive axle. This has made it possible to conveniently arrange the speed reduction mechanism and the speed changing mechanism in the narrow space around the drive axle of the drive-axle tire train 7.

In this specific embodiment, the hydraulic motor 4 is arranged with its output shaft extending downwardly and, as a consequence, the propeller shaft 12 is also disposed extending downwardly and the speed reduction mechanism is arranged on the output side of the propeller shaft 12. As a result, the hydraulic motor 4 which has heretofore been arranged with its length extending in a horizontal direction can be disposed with its length extending in a vertical direction. This has made it possible to enlarge an effective space around the hydraulic motor 4 in the tired roller main body 1, and has also made it no longer necessary to arrange the speed reduction gear 5 and the bearing 6*a* around the hydraulic motor 4 although they have heretofore been arranged around the hydraulic motor 4. As a result, an ample space can be retained around the hydraulic motor 4 in the tired roller main body 1 and a dead space can be reduced, so that the overall volume of water tanks can be increased. In this specific embodiment, the output shaft of the hydraulic motor 4 and the propeller shaft 12 are arranged to extend in the vertical direction so that rotation of the hydraulic motor 4 is downwardly transmitted to the drive axle of the drive-axle tire train 7. As an alternative, however, it is also possible to arrange them to extend in the direction of the length of the tired roller and to dispose the propeller shaft 12 to extend rearwardly so that rotation of the hydraulic motor 4 can be transmitted rearwardly to the drive axle of the drive-axle tire train 7. In this specific embodiment, the hydraulic motors 4, the propeller shafts 12 and the speed reduction mechanisms are arranged in pairs on the left and right sides, respectively, so that the left and right drive-axle tire trains 7 can be independently driven by the corresponding hydraulic motors 7, propeller shafts 12 and speed reduction mechanisms. Depending on the design conditions, these left and right drive-axle tire trains 7 may be driven by a single hydraulic motor 4, a single propeller shaft 12 and the like.

This application claims the priority of Japanese Patent Application No. HEI 9-57971 filed Mar. 12, 1997, which is incorporated herein by reference.

What is claimed is:

1. A tired roller comprising:

a prime mover, a speed change unit having a variable displacement hydraulic pump and a hydraulic motor driven by pressure oil from said variable displacement hydraulic pump and capable of changing a revolution speed of said hydraulic motor by changing a delivery rate of the pressure oil from said variable displacement hydraulic pump, and a speed reduction mechanism for reducing a rotational speed of said hydraulic motor to provide an increased rotating torque, whereby rotation of said speed reduction mechanism is transmitted to a drive axle of a drive-axle tire train, wherein a propeller shaft is connected on an input side thereof to an output side of said hydraulic motor of said speed change unit so that said propeller shaft extends through a space between adjacent tires in said drive-axle tire train, wherein said propeller shaft is provided on an output side thereof with said speed reduction mechanism so that rotation of said hydraulic motor, which has been transmitted via said propeller shaft, is reduced in speed by said speed reduction mechanism and is then transmitted to said drive axle of said drive-axle tire train, and wherein said speed reduction mechanism is constructed of a planetary gear speed-reduction mechanism, which is arranged concentrically with said drive axle of said drive-axle tire train, and a gear transmission mechanism comprising a bevel gear arranged on an input side of said planetary gear speed-reduction mechanism and a pinion arranged on said output side of said propeller shaft and meshing with said bevel gear, so that an axis of rotation to be transmitted from said propeller shaft to said drive axle of said drive-axle tire train is changed in direction by said gear transmission mechanism to extend in the same direction as an axis of said drive axle.

2. A tired roller according to claim 1, wherein in order to transmit rotation of said hydraulic motor to said drive axle of said drive-axle tire train at a speed reduced by said speed reduction mechanism, an axle provided with said drive axle of said drive-axle tire train is arranged, and said axle is provided with said speed reduction mechanism.

3. A tired roller according to claim 1, wherein said hydraulic motor is arranged with an output shaft thereof extending downwardly, and accordingly, said propeller shaft is arranged extending downwardly.

4. A tired roller comprising a pair of drive axles of drive-axle tire trains as defined in claim 1, said drive axles being arranged on left and right sides, respectively, and hydraulic motors, propeller shafts and speed reduction mechanisms as defined in claim 1, said hydraulic motors, propeller shafts and speed reduction mechanisms being arranged in pairs, respectively; and said left and right drive axles of said left and right drive-axle tire trains are independently driven by ones of said paired hydraulic motors, propeller shafts and speed reduction mechanisms and by the other hydraulic motor, propeller shaft and speed reduction mechanism, respectively.

5. A tired roller according to claim 2, wherein said hydraulic motor is arranged with an output shaft thereof extending downwardly, and accordingly, said propeller shaft is arranged extending downwardly.

6. A tired roller comprising a pair of drive axles of drive-axle tire trains as defined in claim 2, said drive axles being arranged on left and right sides, respectively, and wherein said hydraulic motor is one of a plurality of hydraulic motors, said propeller shaft is one of a plurality of propeller shafts, and said speed reduction mechanism is one of a plurality of speed reduction mechanisms, said hydraulic motors, propeller shafts and speed reduction mechanisms being arranged in pairs, respectively, and wherein said left and right drive axles of said left and right drive-axle tire trains are independently driven by ones of said paired hydraulic motors, propeller shafts and speed reduction mechanisms and by the other hydraulic motor, propeller shaft and speed reduction mechanism, respectively.

* * * * *